US006948324B2

(12) United States Patent
Jin

(10) Patent No.: US 6,948,324 B2
(45) Date of Patent: Sep. 27, 2005

(54) REFRIGERATOR COOLER AND HOUSING CABINET AND AN IMPROVED METHOD OF INSERTION OF THE REFRIGERATOR COMPRESSOR UNIT

(75) Inventor: Lai Jin, Dong Dung (CN)

(73) Assignee: Fortune Resources Enterprise, Inc., Bergenfield, NJ (US)

( * ) Notice: Subject to any disclaimer, the term of this patent is extended or adjusted under 35 U.S.C. 154(b) by 225 days.

(21) Appl. No.: 10/611,514

(22) Filed: Jun. 30, 2003

(65) Prior Publication Data

US 2005/0056041 A1 Mar. 17, 2005

(51) Int. Cl.[7] ..... F25D 19/02
(52) U.S. Cl. ..... 62/77; 62/298
(58) Field of Search ..... 62/77, 298

(56) References Cited

U.S. PATENT DOCUMENTS

| | | | | | |
|---|---|---|---|---|---|
| 2,638,755 | A | | 5/1953 | Borgerd | |
| 2,994,211 | A | | 8/1961 | Lehmkuhl et al. | |
| 3,191,897 | A | | 6/1965 | Comerer | |
| 3,230,733 | A | | 1/1966 | Rutishauser et al. | |
| 3,323,625 | A | | 6/1967 | Webster | |
| 3,712,078 | A | * | 1/1973 | Maynard et al. | 62/448 |
| 3,722,975 | A | | 3/1973 | Taylor | |
| 3,819,244 | A | | 6/1974 | Paulick et al. | |
| 3,838,579 | A | | 10/1974 | Ballard | |
| 3,866,867 | A | | 2/1975 | LaRocca | |
| 4,192,564 | A | | 3/1980 | Losert | |
| 4,457,140 | A | * | 7/1984 | Rastelli | 62/261 |
| 4,490,992 | A | | 1/1985 | Chastine | |
| 4,539,737 | A | | 9/1985 | Kerpers et al. | |
| 4,898,004 | A | * | 2/1990 | Richardson | 62/255 |
| 4,920,696 | A | | 5/1990 | Mawby et al. | |
| 4,995,243 | A | * | 2/1991 | Ward | 62/298 |
| 5,086,627 | A | * | 2/1992 | Borgen | 62/229 |
| 5,140,830 | A | * | 8/1992 | Sawyer | 62/298 |
| 5,417,079 | A | * | 5/1995 | Rudick et al. | 62/253 |
| 5,711,162 | A | | 1/1998 | Wolanin et al. | |
| 6,070,424 | A | * | 6/2000 | Bauman et al. | 62/279 |
| 6,094,928 | A | | 8/2000 | Oyabu et al. | |
| 6,094,934 | A | * | 8/2000 | Rand et al. | 62/440 |
| 6,257,013 | B1 | | 7/2001 | Murray et al. | |
| 6,662,588 | B2 | * | 12/2003 | Houk et al. | 62/298 |
| 6,701,739 | B2 | * | 3/2004 | Morse | 62/277 |
| 6,742,343 | B2 | * | 6/2004 | Matonog et al. | 62/77 |
| 6,751,973 | B2 | * | 6/2004 | Erisgen | 62/246 |
| 2001/0042812 | A1 | | 11/2001 | Perzewski | |
| 2002/0125801 | A1 | | 9/2002 | Rauls | |

* cited by examiner

*Primary Examiner*—William E. Tapolcai
(74) *Attorney, Agent, or Firm*—DLA Piper Rudnick Gray Cary US LLP

(57) ABSTRACT

A refrigeration cooler is provided that includes a compartment to house a refrigeration unit. The unit is inserted into the compartment and positioned so as to avoid damaging the compartment or the seal on the top of the unit and to align the evaporation/air flow inlet and outlets located on the unit and in the compartment. This is accomplished by inserting and raising the unit within the compartment. In particular, both the unit and the compartment include incline surfaces that help raise the unit. The inclines raise the unit when the unit is slid into the compartment and the inclines on the back and bottom of the unit engage the bottom of the compartment, and the inclines at the back and bottom of the compartment engage the front of the unit. In this manner, the unit is raised so that the seal engages the upper surface of the compartment securing the unit.

36 Claims, 10 Drawing Sheets

REFRIGERATOR COOLER AND HOUSING CABINET AND AN IMPROVED METHOD OF INSERTION OF THE REFRIGERATOR COMPRESSOR UNIT

FIELD OF INVENTION

The invention relates generally to refrigerator coolers and housing cabinets in addition to an improved method to install, secure and seal a compressor unit into a refrigerator cooler and housing cabinet.

BACKGROUND

In most commercial machines that include refrigeration units, such as industrial refrigerators, commercial refrigerators, coolers and vending machines, it is often necessary to install the refrigerator compressor into the refrigerator housing cabinet, such as during initial assembly or during maintenance. This can be a difficult task since the compressor is heavy and cumbersome. Moreover, in many instances the equipment can be damaged during the insertion and sealing process. This is particularly true for systems in which the compressor, condenser and evaporator are assembled as a single refrigeration unit to be installed in a refrigeration cabinet. In such systems, the top of the refrigerator unit and the interior of the housing cabinet may be harmed during insertion of the refrigeration unit into the cabinet. Specifically, portions of the refrigeration unit and the housing cabinet are often scratched, chipped or torn during insertion.

To correct some of these problems, prior art focused on a variety of solutions. Unfortunately, while some problems were addressed, others were not remedied. For example, in U.S. Pat. No. 4,539,737 to Kerpers et. al., the inventor taught a method for installing a compressor into a cooling device. In particular, U.S. Pat. No. 4,593,737 provided for a mounting plate onto which the user placed the compressor motor. The mounting plate is then installed into the housing cabinet. After connecting the compressor motor to the compressor unit with the proper electrical circuits, the compressor motor is installed and the mounting plate is removed. In this invention, however, the compressor motor is installed separately from, and attached independently to, the other portions of the cooling device. The entire compressor unit is not secured into the housing. As such, it is difficult to move or reposition the cooling device without first disconnecting the coolant conduits of the compressor motor.

Similarly, in U.S. Pat. No. 5,711,162 to Wolanin et al., the patent teaches a refrigerator compressor motor mounting pan arrangement formed from a metal plate. The compressor motor sits atop the plate. The plate also includes wheel wells so that the compressor motor can be transported along with the compressor and refrigerator unit. A series of brackets holds the compressor motor in place on the plate; however, as in the '737 Patent, the compressor and the motor are not completely secured within the housing, but rather, the housing utilizes the brackets to hold the compressor motor in place. Such an arrangement does not allow for the formation of a tight seal between the whole compressor unit and the refrigerator housing.

As noted above, the prior art failed to address problems related to "sealing" or securing the compressor into the cabinet. Specifically, based on the weight and cumbersome nature of the compressor unit, it is often difficult to connect the whole compressor to the cabinet to form a tight seal. In other, unrelated arts, the concept of "sealing" a cooling device within its housing is known; however, in these arts, the applications do not address the issues related to any damage to the cooling unit caused by such sealing mechanisms nor are the compressor units of the same size and heft. For example, U.S. Pat. No. 4,539,737 to Kerpers et al. ("'737 Patent) describes a method for installing a motor-compressor unit in a cooling device, specifically an air conditioner. In this patent, a type of mounting plate is attached to the housing cabinet. During the installation of an air conditioner motor compressor unit, the unit is pushed along flanges attached to the mounting plate until the unit is "sealed" in the cabinet. Again, this combination of features does not alleviate the issues related to damage caused to the unit and/or the housing cabinet. In actuality, the movement of the unit across the flanges and into the cabinet likely will scratch, tear or in some measure damage the cabinet. Furthermore, this patent, while not specifically limited to air conditioners, directs its embodiments to commercial air conditioners and, as such, does not describe how the system would work in the unrelated field of refrigeration units. This is a major concern considering the large discrepancy between the size and function of the appliances.

Accordingly, it is the object of the present invention to provide a refrigerator cooler and housing cabinet with an installed, secured and sealed refrigerator compressor unit.

It is a further object of the present invention to provide a refrigerator cooler and housing cabinet in which a refrigerator compressor unit is installed without damaging the compressor unit, cooler or the cabinet and, at the same time, forming a secure seal between the compressor unit and the cooler and cabinet.

It is a further object of the present invention to provide a refrigerator cooler and housing cabinet with an installed, secured and sealed refrigerator compressor unit in which the method of installing, securing and sealing the unit is safe and easy to perform.

It is still a further object of the present invention to provide a refrigerator cooler and housing cabinet with an installed, secured and sealed refrigerator compressor unit that is economical to manufacture.

It is still a further object of the invention to provide a refrigerator cooler and housing cabinet with an installed, secured and sealed refrigerator compressor unit that is durable and can be used by businesses as well as individuals.

Other objects and advantages will be apparent from the remaining portion of the specification.

SUMMARY OF THE INVENTION

The preferred embodiment of the apparatus of the present invention includes a refrigerator cooler with a housing cabinet that includes an opening for the insertion of the refrigeration unit. The refrigerator cooler may be a industrial refrigeration unit, commercial refrigerator, vending machine or any other machine with requirement for a refrigeration unit. The refrigeration unit has a back side, a front side, a lower side and an upper side. In the preferred embodiment, the refrigeration unit is made of metal. The upper surface of the unit includes an evaporator inlet opening and evaporator cool air exhaust opening. The perimeter of these openings are surrounded by a seal—preferably made of neoprene or a similar flexible material. Further, the lower side includes two incline surfaces that both extend downwardly towards the front side of the unit. Each inclined surface also includes a horizontal resting surface so that when the refrigeration unit is resting inside the cooler and compartment, the unit rests upon the horizontal resting surface. In the preferred embodiment, the unit also includes a flat metal plate or lip that extends downward from the front side of the unit. This lip includes openings for mating with bolts on the cooler to help secure the unit in place in the cooler.

The refrigeration unit housing compartment has a back side, a front side, a lower side and an upper side and an opening to receive the unit. In addition, the compartment has an upper support surface and a lower support surface, both preferably made of metal. The upper surface of the cabinet also includes an evaporator inlet opening and an evaporator cool air exhaust opening. These openings align with the corresponding openings on the unit so as to allow the air flow from the unit through the openings and into the cooler.

In addition, the lower support surface of the compartment also has two incline surfaces that extend upwardly towards the back surface of the compartment. These incline surfaces also include horizontal resting surfaces onto Which the unit will ultimately sit.

The compartment includes rails along the lower surface. The unit slides along the rails until the unit's incline surfaces engage the rails and simultaneously the lower incline surfaces of the compartment engage the unit so as to lift or raise the unit and raise it into position. In this position, the seal of the unit engages the upper portion of the compartment. In the preferred embodiment, the seal includes a magnetic core so that the seal will be secured against the upper portion of the metal compartment.

In addition, the lower surface of the compartment includes a bracket that runs across the front of the lower surface of the compartment. This bracket includes the aforementioned bolts that are secured into the openings in the lower lip of the unit. In this manner, the unit is secured inside the refrigeration compartment without damaging the unit or the compartment.

DETAILED DESCRIPTION

Figure 1:
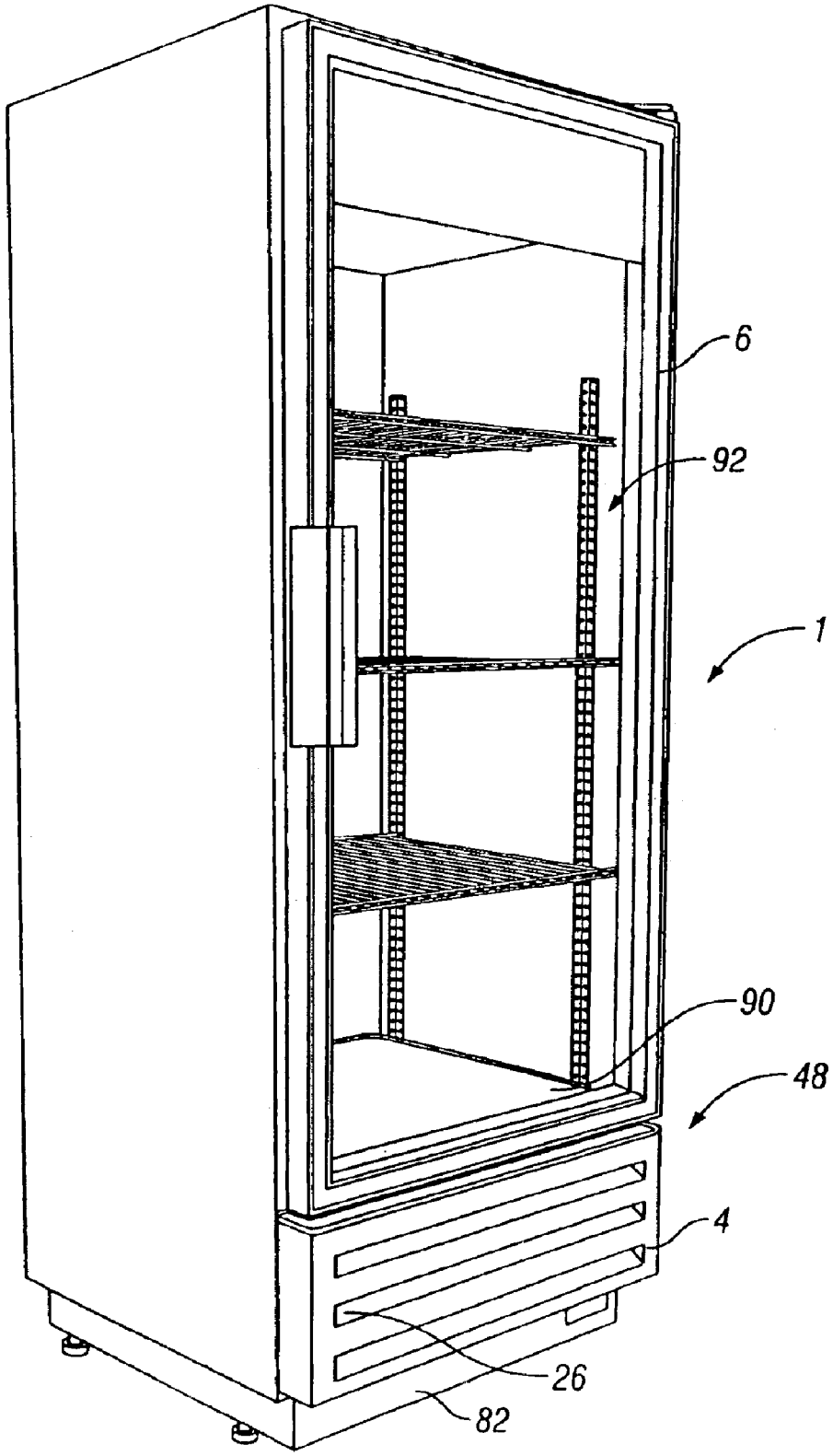
FIG. 1 is a left front perspective view of the fully assembled refrigerator cooler.
Figure 2:
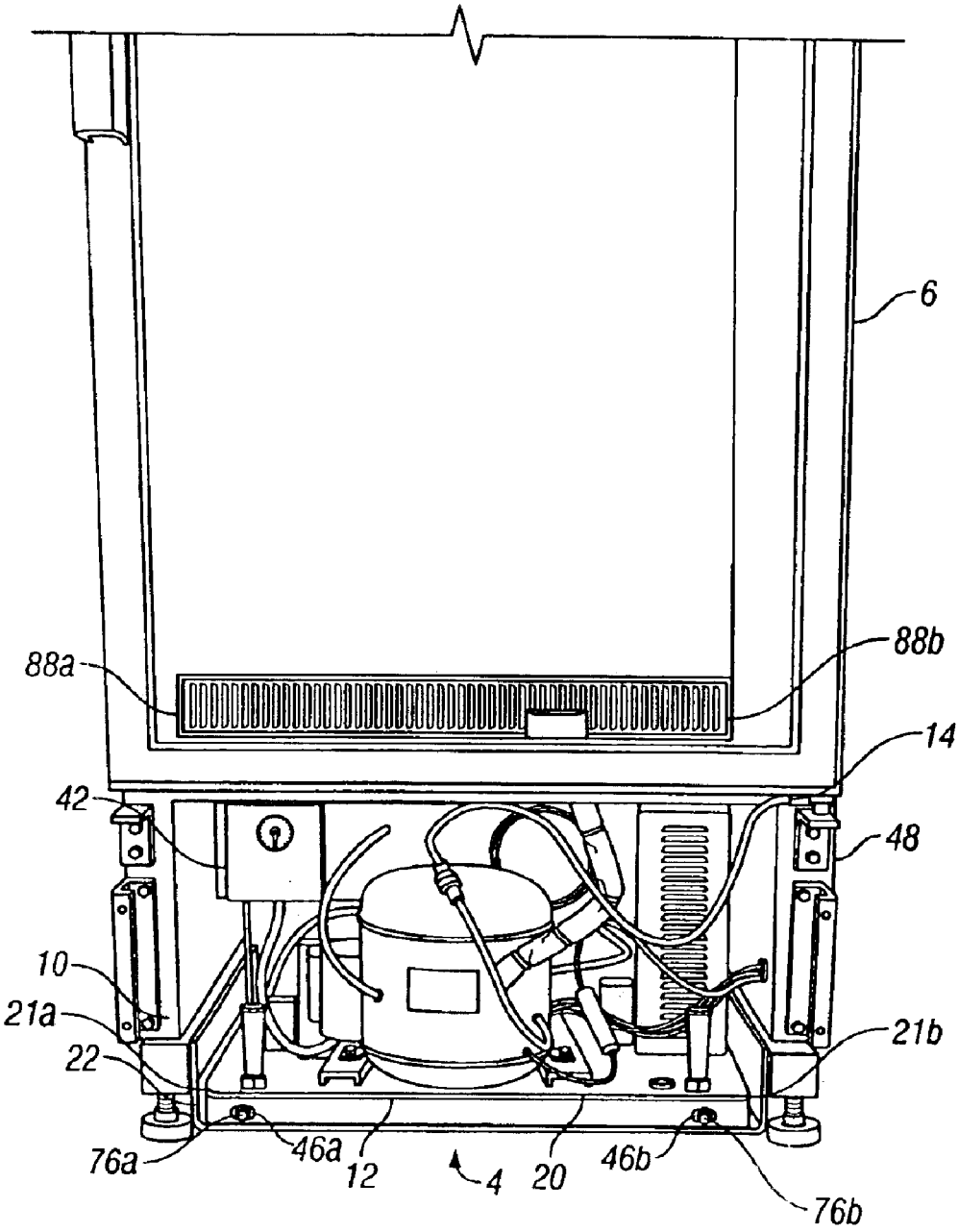
FIG. 2 is a front perspective view of the unit installed, secured and sealed into the refrigerator cabinet.
Figure 3:
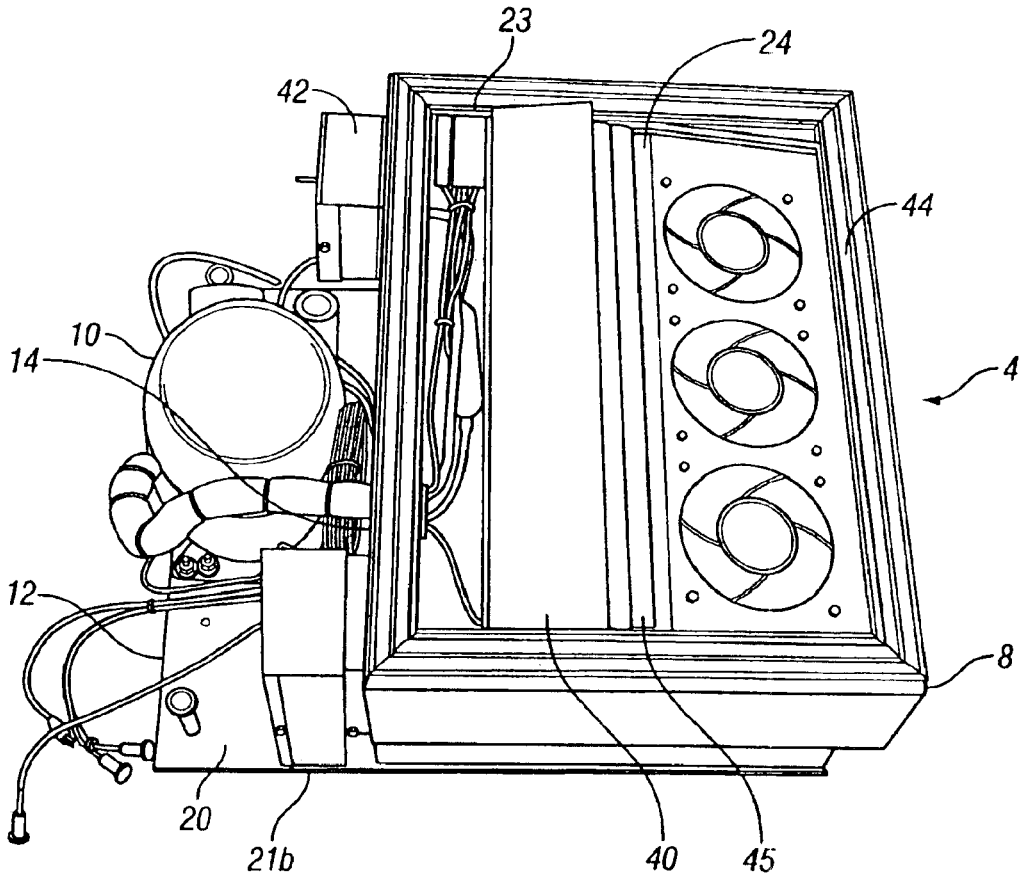
FIG. 3 is a right, top perspective view of the unit prior to installation.
Figure 4:
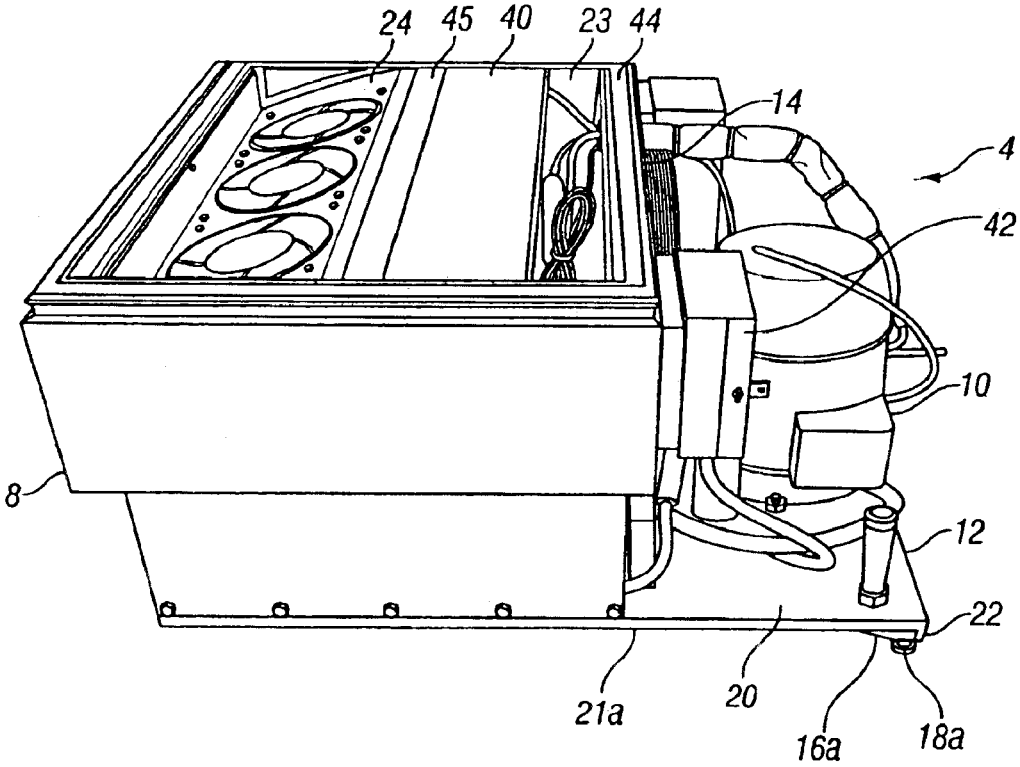
FIG. 4 is a left side perspective view of the unit prior to installation.
Figure 5:
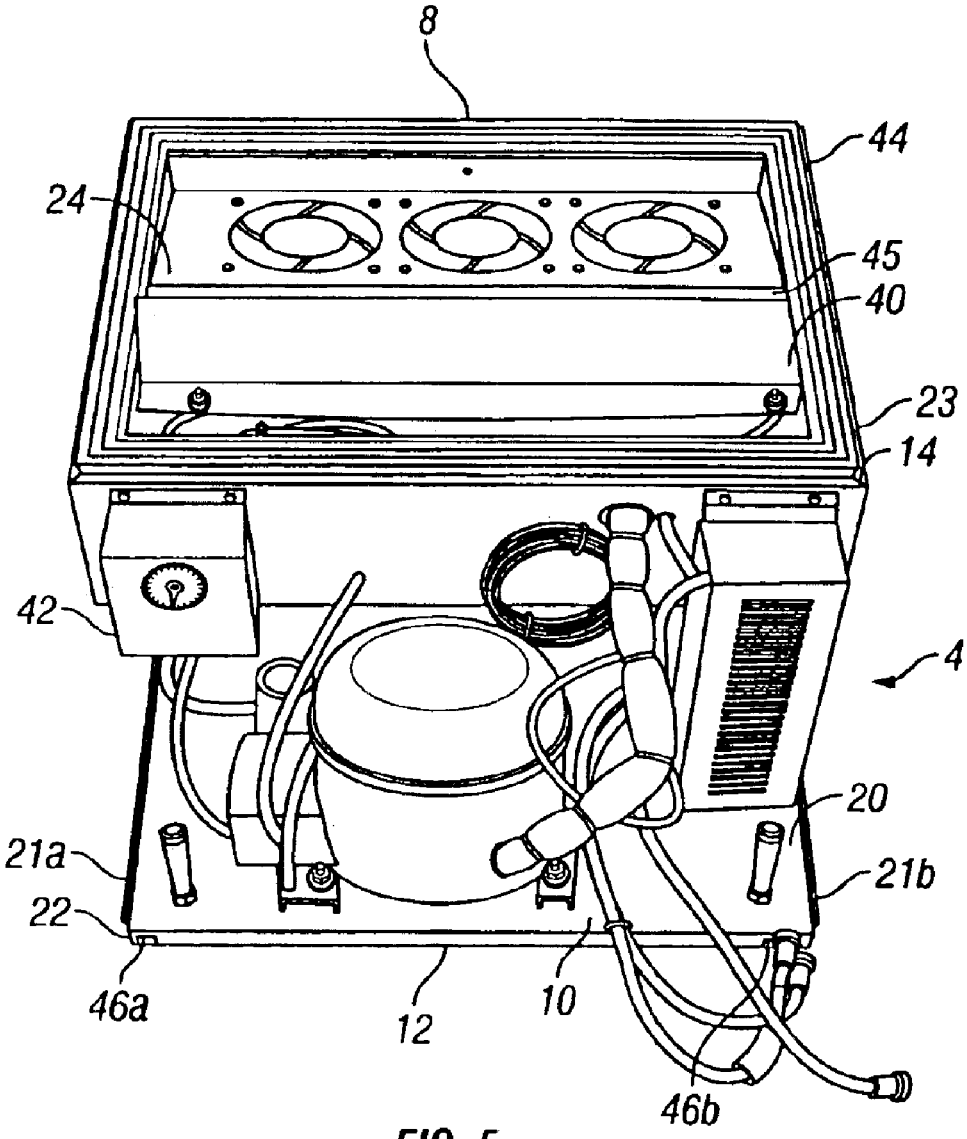
FIG. 5 is a front, top perspective view of the unit prior to installation.
Figure 6:
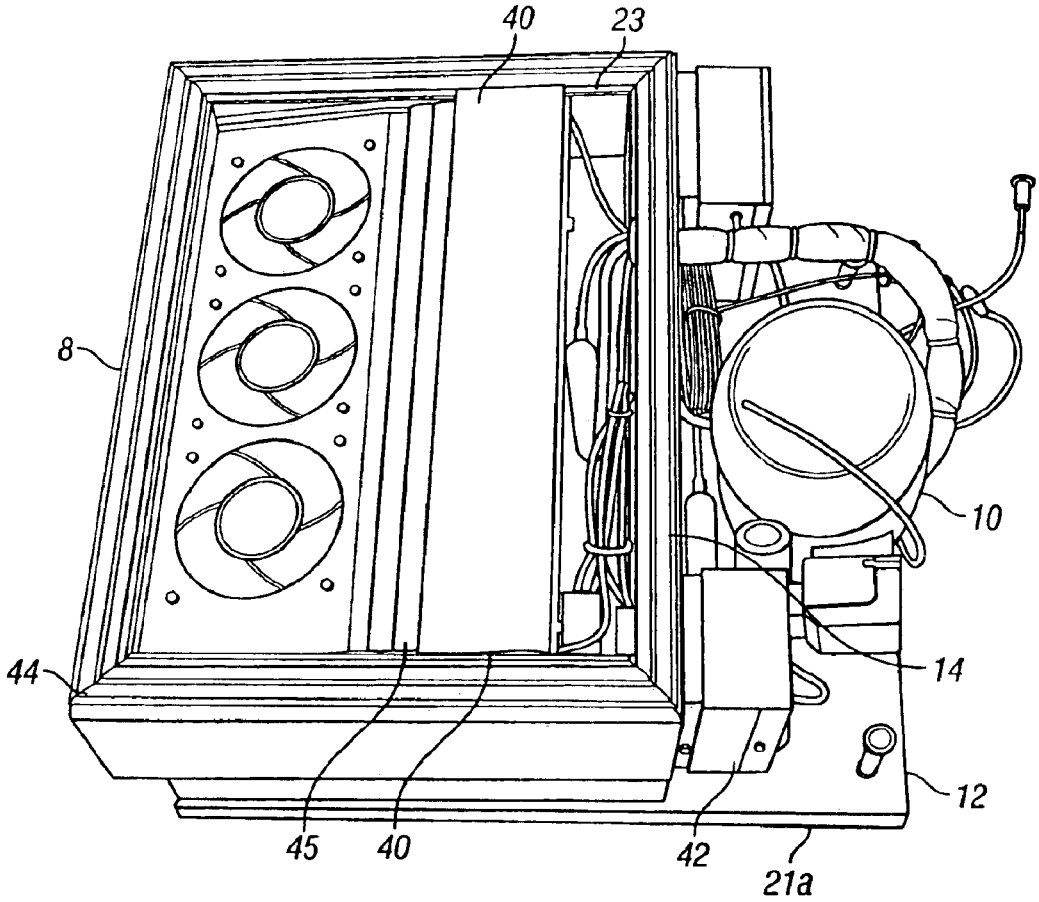
FIG. 6 is a left, top perspective view of the unit prior to installation.
Figure 7:
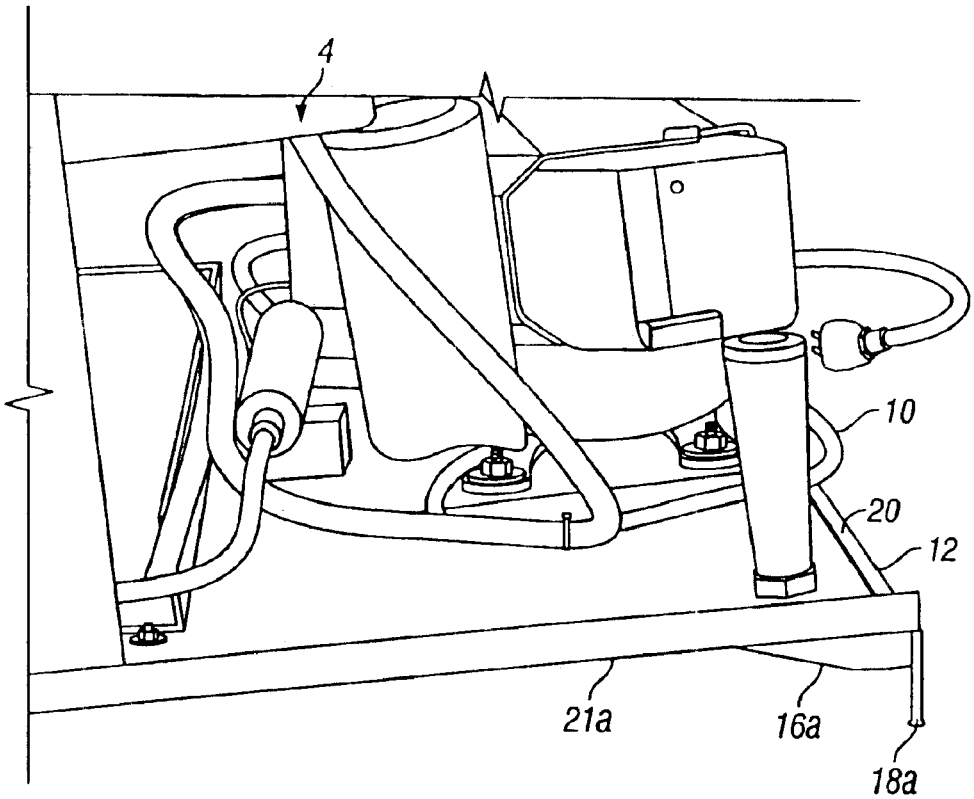
FIG. 7 is a left side perspective view of the incline of the unit.

A refrigerator cooler 1 constructed in accordance with the present invention is seen generally in FIG. 1. As seen in FIGS. 1 and 2, the refrigerator cooler 1 includes a refrigeration unit 4 and a refrigeration cabinet 6.

As seen throughout FIGS. 2–7, the refrigeration unit 4 has a backside 8, a front side 10, a lower side 12 and an upper side 14. In the preferred embodiment of the invention, the refrigeration unit 4 is preferably made of metal. Further, the lower side 12 preferably includes a left side and right side incline surface 16*a* and 16*b* that both extend downwardly towards the front side 12. The right side incline surface 16*b* is not shown well, but is a mirror-image of the left side incline surface 16*a*. Each incline surface 16*a* and 16*b* includes an adjacent horizontal resting surface 18*a*, 18*b* so that when the refrigeration unit or "unit" 4 is inside the cooler 1, the unit 4 rests upon the horizontal resting surfaces 18*a*, 18*b* to support the unit 4 in the cooler 1.

Also as seen in FIGS. 2–7, the lower surface 12 preferably includes a flat metal plate 20 with a downwardly extending lip 22 from the front side 12 of the unit 4. In the preferred embodiment, the downward extending lip 22 includes openings 46*a* and 46*b*, but may include other similar mating devices, for engagement with the cooler 1.

Figure 8:
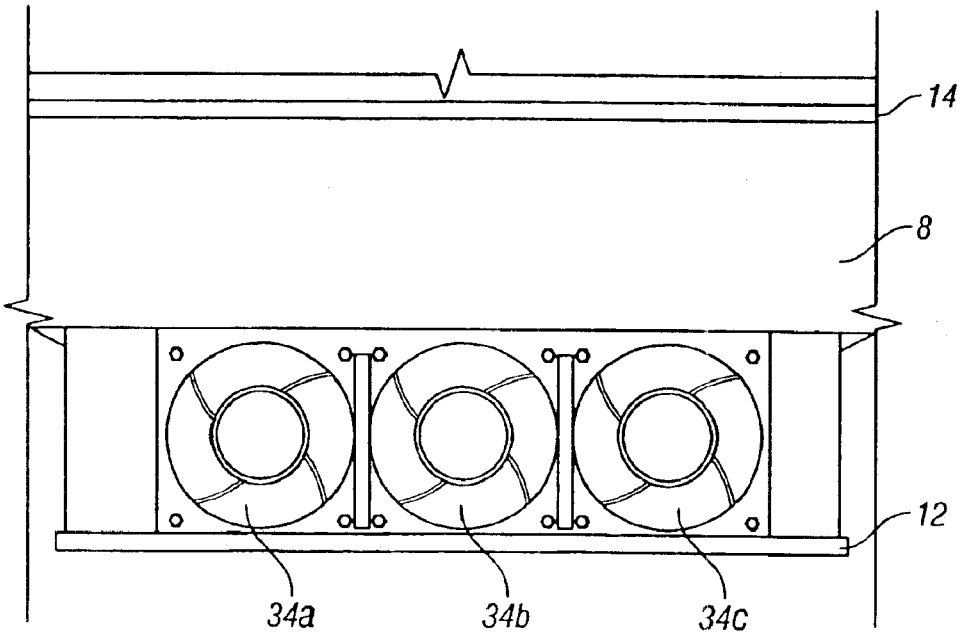
FIG. 8 is a back view of the fans located within the unit.

As demonstrated in FIGS. 3–7, the upper side 14 of the unit 4 preferably includes an evaporator inlet opening 23 and an evaporator cool air exhaust opening 24. In addition, the vent 26, as seen in FIG. 1, allows the flow of ambient air into the refrigeration unit 4. Specifically, the interior (not shown) of refrigeration unit 4 is divided into a lower interior and upper interior section (not shown). In the preferred embodiment, the lower interior section includes the condenser (not shown). The backside 8, adjacent to the lower section, includes three fans 34*a*, 34*b* and 34*c*, which can be seen in FIG. 8. The three fans 34*a*, 34*b* and 34*c* ventilate the lower interior section and cool the condenser by pulling the ambient air through the front side of the interior of the refrigeration unit 4 and through vent 26, then across the condenser. The resultant heated air is then released out of the backside through the three fans 34*a*, 34*b* and 34*c* and out the back vent 80 of the compartment 48.

The lower and upper interior sections are separated so that the condenser and the evaporator (not shown) of the unit 4 are separated. As seen in FIGS. 3–6, the evaporator is covered by a shock absorber 40 (made preferably of Styrofoam or some other similar shock absorbing material). In addition, unit 4 includes a temperature control gauge 42 to regulate the temperature of the air circulated through the cabinet 6.

As seen in FIGS. 3–6 and 11*a*–*c*, the upper side of the refrigeration unit 14 includes a seal 44 secured around the perimeter of the evaporator inlet opening 23 and evaporator cool air exhaust opening 24. Preferably the seal 44 is made of a flexible material such as neoprene and may include a magnate core. In addition, the seal 44 includes a dividing section 45 as seen in FIGS. 3–6. The dividing section 45 separates the evaporator inlet opening 23 and the evaporator cool air exhaust opening 24 so that the air flow is not intermixed.

Figure 9:
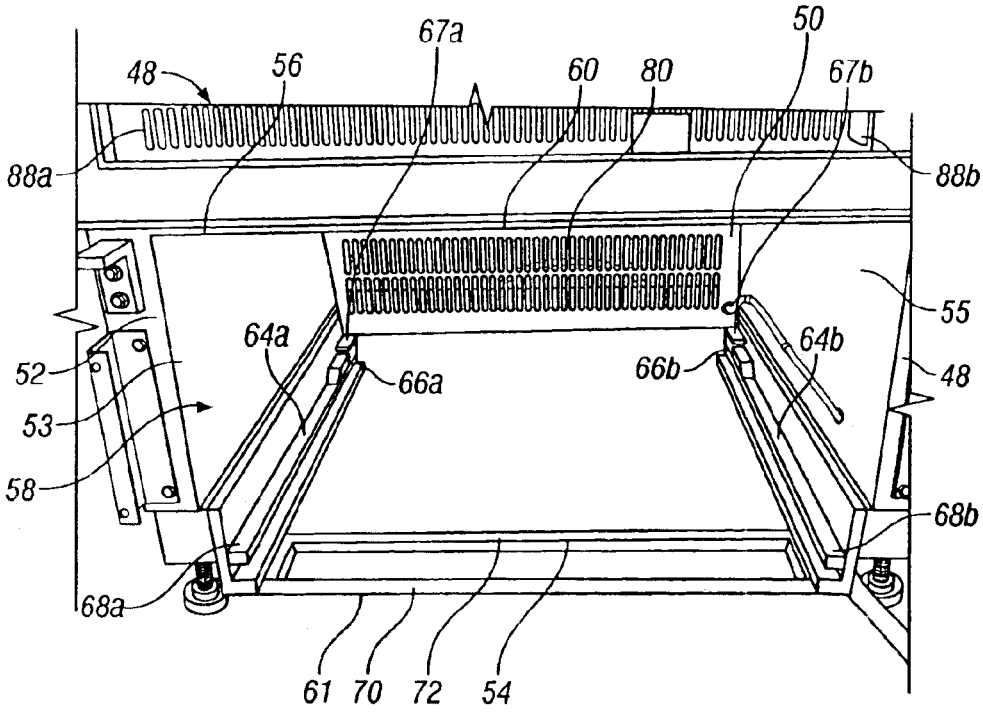
FIG. 9 is a front perspective view of the refrigerator cabinet.
Figure 10:
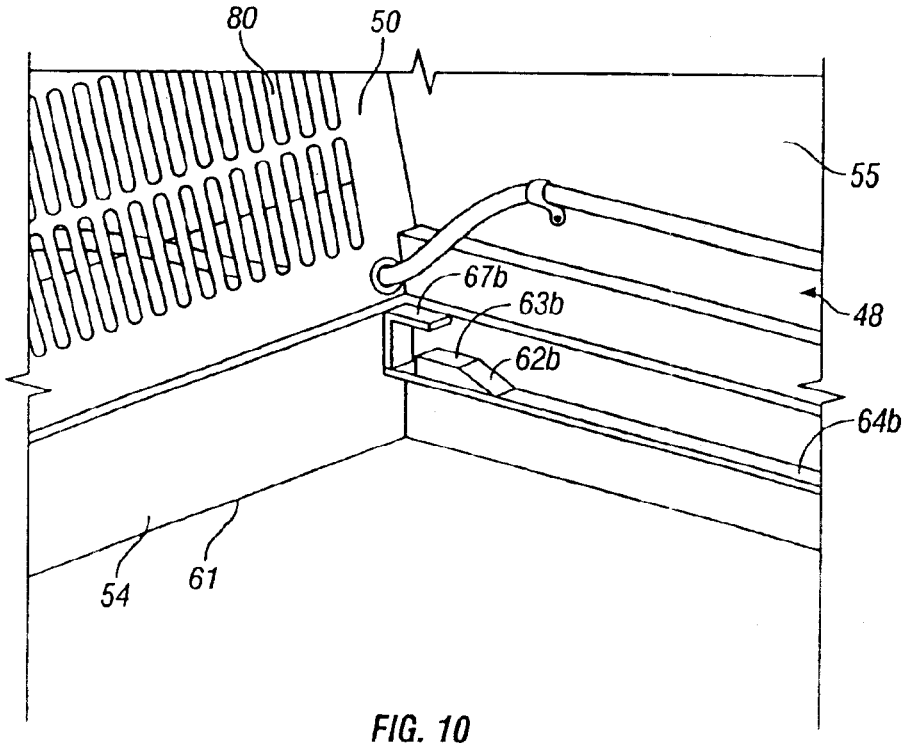
FIG. 10 is a perspective view of the lower right portion of the compartment.

As seen generally in FIGS. 1, 2 and more clearly in FIGS. 9 and 10, the cooler 1 includes the refrigeration unit housing compartment or compartment 48. The compartment 48 houses the refrigeration unit 4. The compartment 48 has a backside 50, a front side 52, a left side 53, a lower side 54, a right side 55, an upper side 56 and an opening seen generally at 58. The unit 4 is adapted to slide into opening 58. In addition, the compartment 48 has an upper support surface 60 and a lower support surface 61. The lower support surface 61 is preferably made of metal. The lower support surface 61 preferably has two incline surfaces 62*a* and 62*b*, as demonstrated in FIGS. 10 and 11*a–c*. The inclines 62*a* and 62*b* operate similarly to inclines 16*a* and 16*b* of the unit 4. Incline surfaces 62*a* and 62*b* include horizontal resting surfaces 63*a* and 63*b* onto which the unit 4 will ultimately sit during the installed position. Incline surface 62*a* and 62*b* are located at the backside 50 and extend in an upward manner, towards the backside 50.

More particularly, the incline surfaces 62*a* and 62*b* are located along rails 64*a* and 64*b* which are located on the lower support surface 61, as seen in FIGS. 9, 10 and 11*a–c*. The rails 64*a* and 64*b* extend along the left and right sides 53, 55 of the compartment 48 along the lower support surface 61. Each rail 64*a* and 64*b* has a back end 66*a* and 66*b* and a front end 68*a* and 68*b*. The back ends 66*a* and 66*b* include two stops 67*a* and 67*b* that abut the unit 4 in the resting position as shown clearly in FIGS. 11*a*–11*c*.

Figure 11A:
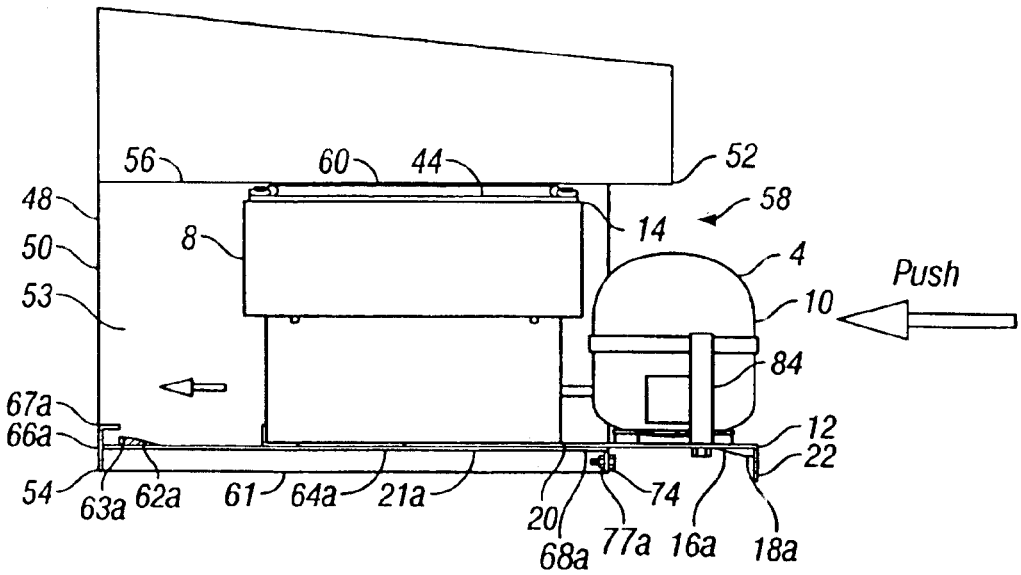
FIG. 11*a* is a left side perspective of the unit as it enters the cabinet.
Figure 11B:
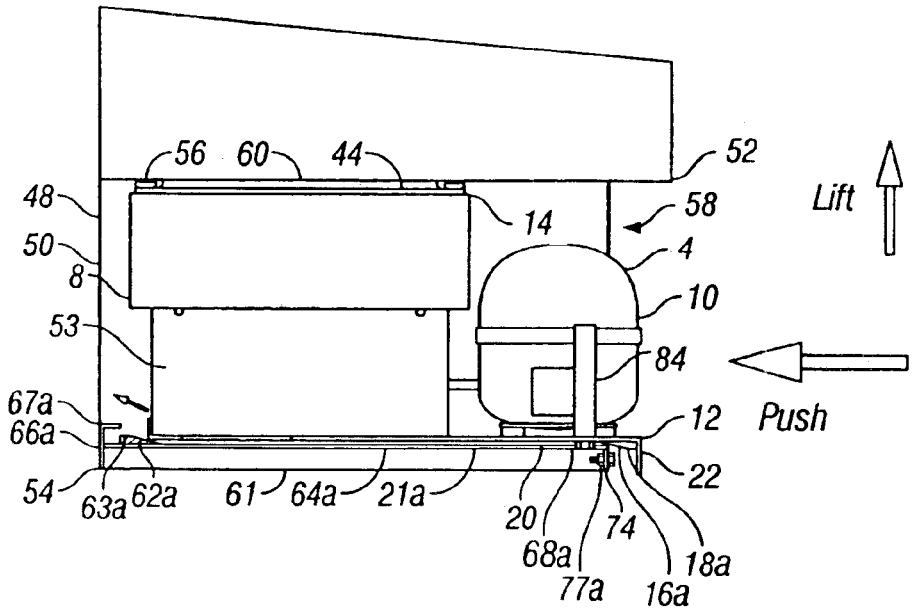
FIG. 11*b* is a left side perspective view of the unit of 11*a* as it is pushed along line 11—11.
Figure 11C:
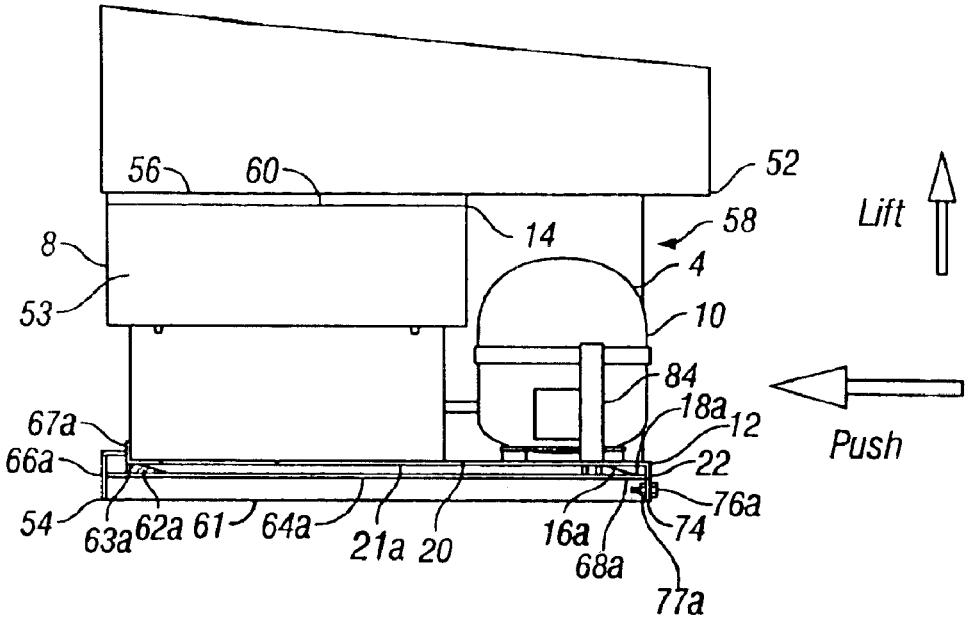
FIG. 11*c* is a left side perspective view of the compressor unit of 11*a* as it reaches its final position.

As shown in FIG. 9, the compartment 48 also preferably includes a bracket 70 spanning across the front side 52 of the cabinet 48. The bracket 70 preferably includes a horizontal surface 72 that forms part of the lower support surface 61. The bracket 70 also includes a downwardly extending lip 74, shown in FIGS. 11*a–c*, that preferably includes bolts 76*a* and 76*b*, shown in FIGS. 2 and 11*c*, on each side of the bracket 70. FIG. 2 clearly demonstrates the bolts 76*a* and 76*b* engaging the corresponding openings 46*a* and 46*b* in the downwardly extending lip 22 of the unit 4. FIGS. 11*a*–11*c* show the nuts 77*a* and 77*b*, (77*b* is not well shown, but is a mirror-image of 77*a*) affixed to the bracket 70, which receive the corresponding bolts 76*a* and 76*b*. In this preferred embodiment, the nuts 77*a* and 77*b* receive the respective bolts 76*a* and 76*b* to secure the refrigeration unit 4 within the compartment 48.

A grill cover 82, as seen in FIG. 1, and includes the vent 26 to allow the ambient airflow into the interior of the unit 4 to provide the aforementioned ventilation across interior of the unit 4.

As seen clearly in FIGS. 11*a–c*, the unit 4 in the preferred embodiment has at least 1 handle 84 for pushing or pulling the unit 4 into or out of the compartment 48. Specifically, as the unit 4 is pushed along site line 11—11 (as shown in 11*a*, 11*b* and 11*c*) it enters into the compartment 48 of the cooler 1. Initially, the lower metal plate 20 of the unit 4, comes into contact with the horizontal surface 72 of the bracket 70, and the rails 64*a* and 64*b*. Further advancement of the unit 4 into the compartment 48 causes the side edges 21*a* and 21*b* of the metal plate 20 to slide along the rails 64*a* and 64*b*. Eventually the lower metal plate 20 engages the incline surfaces 62*a*, 62*b* and the horizontal surface 72 engages the incline surfaces 16*a*, 16*b*. As the unit 4 advances yet further into the compartment 48, the metal plate 20 and horizontal surface 72 slide upward along the incline surfaces 62*a*, 62*b* and the inclines surfaces 16*a*, 16*b*, respectively, causing the unit 4 to move further into the compartment 48, while simultaneously causing the unit 4 to move upward.

Up to this point, a space existed between the unit 4 and upper surface of the compartment 60. However, as the unit 4 moves upward in the compartment 48, the space decreases as seen clearly in FIG. 11*b* and 11*c*. Ultimately, when the unit 4 comes to a resting position on the horizontal surfaces 18*a* and 18*b* of unit 4 as well as the horizontal surfaces 63*a* and 63*b* of the compartment 48, the unit 4 will abut against the stops 67*a* and 67*b*. In addition, the seal 44 is now pressed tightly against the upper surface of the compartment 60. This secures the unit 4 in place within the compartment 48. In addition, as previously noted, the seal 44 may have a magnetic core and, as such, the seal 44 is additionally secured, magnetically, with the upper support surface of the compartment 60. Once in this position, the bolts 74*a* and 74*b* may be inserted into the openings 46*a*, 46*b* and secured in place via nuts 77*a* and 77*b*, so that the unit 4 can be securely fastened into the compartment 48.

Figure 12:
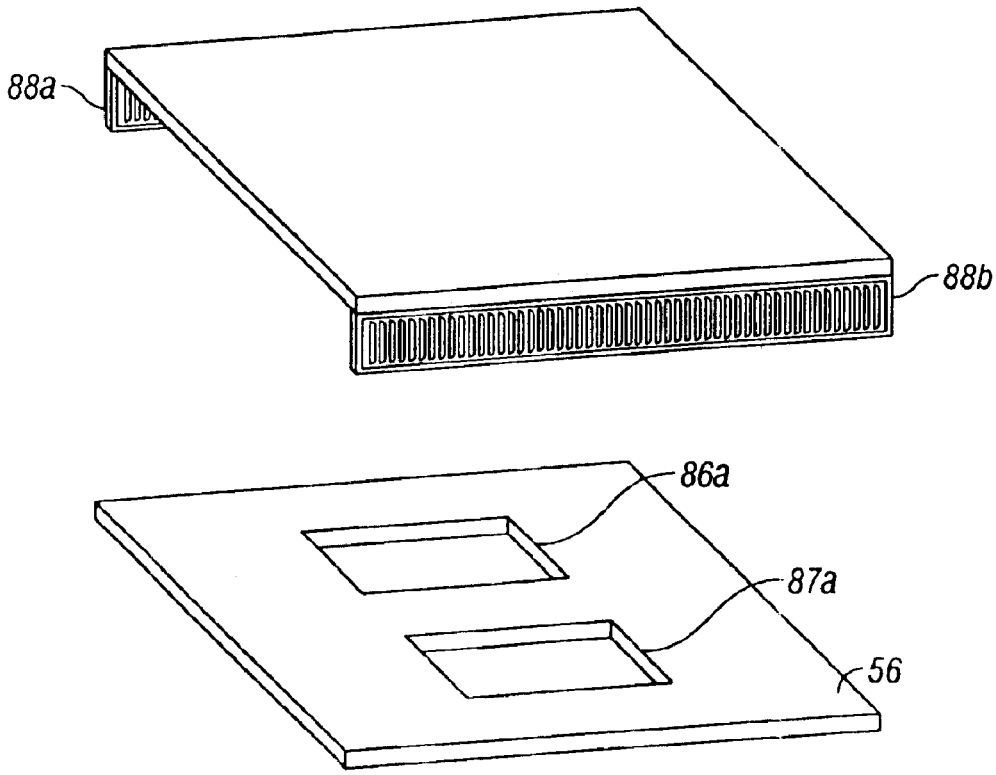
FIG. 12 is a left front exploded view of the aligned openings in the unit and the cabinet.

FIG. 12 shows openings 86*a* and 86*b* of compartment 48 that are aligned with the evaporator inlet opening 23 and outlet 24 of the unit 4, when the unit 4 is in the installed position of FIG. 11*c*. The openings 86*a* and 86*b* are found in the upper surface 56 of the compartment 48. The openings 86*a* and 86*b* allow the flow of air from the corresponding evaporator inlet opening 23 and evaporator cool air exhaust opening 24 to circulate air in the refrigeration cooler cabinet 6. Specifically, the airflow circulates through a baffling system 88*a* and 88*b* to the refrigeration cooler cabinet 6. The details of the baffling system 88*a*, 88*b* are not shown. However, one skilled in the art will appreciate the requirements of the baffling system. In this manner, the refrigeration cooler cabinet 6 is cooled. As seen clearly in FIG. 1, the openings 86*a* and 86*b* are covered (preferably) by a hard plastic sheet 90 so that food items in the refrigeration cooler cabinet 6 do not slip through the openings 86*a* and 86*b* and into the unit 4. The refrigeration cooler cabinet 6 can maintain food items of other products in a variety of methods including the shelving system as seen generally at 92 as shown in FIG. 1 or in a vending machine-type format.

What is claimed is:

1. A refrigeration cooler comprising:

a refrigeration unit having a back side, a front side, lower side and an upper side, an inclined surface extending downwardly adjacent and towards the front side, the upper side includes a first set of an evaporator inlet opening and an evaporator cool air exhaust opening;

a cabinet having a compartment for receiving the refrigeration unit, a back side, a front side, a lower side, and an upper side, the compartment includes a compartment opening, a lower support surface and an upper surface, the lower support surface is adapted for receiving the refrigeration unit and includes an inclined surface extending upwardly adjacent and towards the back side, the upper surface includes a second set of an evaporator inlet opening and an evaporator cool air exhaust opening;

a seal secured around a perimeter of the evaporator inlet opening and the evaporator cool air exhaust opening of either the first set or the second set, whereby when the refrigeration unit is slid into the compartment opening, along the lower support surface and below the upper surface, the seal is in an uncompressed state, and after further insertion into the compartment, the back side of the refrigeration unit engages the inclined surface of the cabinet, and the front side of the cabinet engages the inclined surface of the refrigeration unit, causing the refrigeration unit to be lifted and thus compressing the seal so as to seal the first set of openings with the second set of openings.

2. The refrigeration cooler of claim 1, wherein the seal is secured around the perimeter of the first set of openings, whereby when the refrigeration unit is lifted within the cabinet, the seal is compressed against the upper surface of the cabinet.

3. The refrigeration cooler of claim 1, wherein the lower side of the refrigeration unit includes a first inclined surface and a second inclined surface, each inclined surface extending downwardly, adjacent and towards the front side, the first inclined surface located at the left side and the second inclined surface located at the right side, and the cabinet includes a first inclined surface and a second inclined surface, each inclined surface extending upwardly adjacent and towards the back side, the first inclined surface located at the left side and the second inclined surface located at the right side.

4. The refrigeration cooler of claim 1, wherein the lower support surface includes a first rail extending along the left side and a second rail extending along the right side, each rail has a back end and a front end.

5. The refrigeration cooler of claim 4, wherein the first and second inclined surfaces of the cabinet extend upwardly from the back end of the respective first and second rail.

6. The refrigeration cooler of claim 1, wherein the lower side of the refrigeration unit includes a flat metal plate, with a downwardly extending lip at the front side, and the cabinet includes a bracket spanning across the front side of the cabinet, the bracket having a horizontal surface forming part of the lower support surface, and a downwardly extending lip at the front side, whereby with the refrigeration unit installed in the cabinet, the downwardly extending lip of the unit is in mating engagement with the downwardly extending lip of the cabinet.

7. The refrigeration cooler of claim 6, wherein the downwardly extending lips include openings aligned with one another for receiving a fastener for retaining the unit in the installed position.

8. The refrigeration cooler of claim 1, wherein the back side of the cabinet includes an abutment for defining the fully installed position of the unit within the compartment.

9. The refrigeration cooler of claim 1, wherein each surface includes an adjacent horizontal resting surface, wherein in the installed position, the unit rests upon the horizontal resting surfaces of the cabinet, and the horizontal resting surfaces of the unit support the unit in a spaced apart relation upon the lower side of the cabinet.

10. The refrigeration cooler of claim 1, wherein the refrigeration unit includes at least one handle to assist in sliding the unit into or out of the compartment.

11. The refrigeration cooler of claim 1, wherein the back side of the cabinet includes a vent, and a grill cover is secured to the refrigeration cooler to close off the compartment, whereby the vent and grill cover allow circulation to remove heat generated by the refrigeration unit.

12. The refrigeration cooler of claim 11, wherein the refrigeration unit includes a left wall, a right wall, and a cooling fan for directing ambient air to enter the refrigeration unit from the grill cover, through the refrigeration unit, and out of the refrigeration cooler via the vent, thereby cooling the refrigeration unit.

13. The refrigeration cooler of claim 1, wherein the seal includes a magnetic core.

14. A refrigeration unit compartment including a refrigerator unit comprising:

a refrigeration unit having a back side, a front side, lower side and an upper side, an inclined surface extending downwardly adjacent and towards the front side, the upper side includes a first set of an evaporator inlet opening and an evaporator cool air exhaust opening;

the refrigerator unit compartment includes an opening for receiving the refrigeration unit, a lower support surface and an upper surface, the lower support surface is adapted for receiving the refrigeration unit and includes an inclined surface extending upwardly adjacent and towards the back side, the upper surface includes a second set of an evaporator inlet opening and an evaporator cool air exhaust opening;

a seal secured around a perimeter of the evaporator inlet opening and the evaporator cool air exhaust opening of either the first set or the second set, whereby when the refrigeration unit is slid into the refrigerator unit compartment opening, along the lower support surface and below the upper surface, the seal is in an uncompressed state, and after further insertion into the refrigerator unit compartment, the back side of the refrigeration unit engages the inclined surface of the refrigerator unit compartment, and the front side of the refrigerator unit compartment engages the inclined surface of the refrigeration unit, causing the refrigeration unit to be lifted and thus compressing the seal so as to seal the first set of openings with the second set of openings.

15. The refrigeration unit compartment of claim 14, wherein the seal is secured around the perimeter of the first set of openings, whereby when the refrigeration unit is lifted within the refrigeration unit compartment, the seal is compressed against the upper surface of the refrigeration unit compartment.

16. The refrigeration unit compartment of claim 14, wherein the lower side of the refrigeration unit includes a first inclined surface and a second inclined surface, each inclined surface extending downwardly, adjacent and towards the front side, the first inclined surface located at the left side and the second inclined surface located at the right side, and the refrigeration unit compartment includes a first inclined surface and a second inclined surface, each inclined surface extending upwardly adjacent and towards the back side, the first inclined surface located at the left side and the second inclined surface located at the right side.

17. The refrigeration unit compartment of claim 14, wherein the lower support surface includes a first rail extending along the left side and a second rail extending along the right side, each rail has a back end and a front end.

18. The refrigeration unit compartment of claim 17, wherein the first and second inclined surfaces of the refrigeration unit compartment extend upwardly from the back end of the respective first and second rail.

19. The refrigeration unit compartment of claim 14, wherein the lower side of the refrigeration unit includes a flat metal plate, with a downwardly extending lip at the front side, and the refrigeration unit compartment includes a bracket spanning across the front side of the refrigeration unit compartment, the bracket having a horizontal surface forming part of the lower support surface, and a downwardly extending lip at the front side, whereby with the refrigeration unit installed in the refrigeration unit compartment, the downwardly extending lip of the refrigeration unit is in mating engagement with the downwardly extending lip of the refrigeration unit compartment.

20. The refrigeration unit compartment of claim 19, wherein the downwardly extending lips include openings aligned with one another for receiving a fastener for retaining the refrigeration unit in the installed position.

21. The refrigeration unit compartment of claim 14, wherein the back side of the refrigeration unit compartment includes an abutment for defining the fully installed position of the refrigeration unit within the refrigeration unit compartment.

22. The refrigeration unit compartment of claim 14, wherein each surface includes an adjacent horizontal resting surface, wherein in the installed position, the refrigeration unit rests upon the horizontal resting surfaces of the refrigeration unit compartment, and the horizontal resting surfaces of the refrigeration unit support the refrigeration unit in a spaced apart relation upon the lower side of the refrigeration unit compartment.

23. The refrigeration unit compartment of claim 14, wherein the refrigeration unit includes at least one handle to assist in sliding the refrigeration unit into or out of the refrigeration unit compartment.

24. The refrigeration unit compartment of claim 14, wherein the back side of the refrigeration unit compartment includes a vent, and a grill cover is secured to the refrigeration unit compartment to close off the refrigeration unit compartment, whereby the vent and grill cover allow circulation to remove heat generated by the refrigeration unit.

25. The refrigeration unit compartment of claim 24, wherein the refrigeration unit includes a left wall, a right wall, and a cooling fan for directing ambient air to enter the refrigeration unit from the grill cover, through the refrigeration unit, and out of the refrigeration unit compartment via the vent, thereby cooling the refrigeration unit.

26. The refrigeration unit compartment of claim 14, wherein the seal includes a magnetic core.

27. The refrigeration unit compartment of claim 14, wherein the upper support surface engages a refrigeration cabinet.

28. The refrigeration unit compartment of claim 27, wherein the refrigeration cabinet sits on the upper support surface of the refrigeration unit compartment so that the second set of evaporator inlet opening and evaporator cool air exhaust opening are not compromised or impeded.

29. A method of inserting a refrigeration unit into a refrigeration unit compartment comprising:

handling the refrigeration unit;

moving the refrigeration unit towards the refrigeration unit compartment;

fitting the refrigeration unit with the refrigeration unit compartment;

inserting the refrigeration unit into the refrigeration unit compartment;

engaging an incline portion of the refrigeration unit with an incline portion of the refrigeration unit compartment;

raising the refrigeration unit in the refrigeration unit compartment as the incline portions of the refrigeration unit and the refrigeration unit compartment, respectively, are engaged;

compressing a seal on the refrigeration unit as the refrigeration unit is raised in the refrigeration unit compartment;

raising the refrigeration unit in the refrigeration unit compartment until such time as the refrigeration unit can no longer be further inserted; and securing the refrigeration unit in the refrigeration unit compartment.

30. The method of claim 29 further comprising providing a refrigeration unit with an upper side, which upper side includes a first evaporator inlet opening and an evaporator cool air exhaust opening.

31. The method of claim 30 further comprising providing a refrigeration unit compartment with an upper surface, which upper surface includes a second evaporator inlet opening and an evaporator cool air exhaust opening.

32. The method of claim 31 further comprising inserting and aligning the refrigeration unit in the refrigeration unit compartment until the respective evaporator inlet opening and evaporator cool air exhaust opening align.

33. The method of claim 29 further comprising providing the refrigeration unit compartment with a back side that mates with the inclined surface of the refrigeration unit compartment.

34. The method of claim 33 further comprising raising the refrigeration until the seal of the of the refrigeration unit engages and is compressed by the upper surface of the refrigeration unit compartment.

35. The method of claim 33 further comprising inserting the refrigeration unit until the seal of the refrigeration unit engages and is compressed by the upper surface of the refrigeration unit compartment.

36. The method of claim. 33 further comprising inserting and raising the refrigeration unit until the seal of the refrigeration unit engages and is compressed by the upper surface of the refrigeration unit compartment.

* * * * *